US010508491B2

(12) United States Patent
Huang

(10) Patent No.: US 10,508,491 B2
(45) Date of Patent: Dec. 17, 2019

(54) RETAINING DEVICE FOR AN OPERATING MEMBER OF A WINDOW SHADE AND WINDOW SHADE USING THE SAME

(71) Applicant: Teh Yor Co., Ltd., New Taipei (TW)

(72) Inventor: Chien-Fong Huang, New Taipei (TW)

(73) Assignee: Teh Yor Co., Ltd., New Taipei (TW)

( * ) Notice: Subject to any disclaimer, the term of this patent is extended or adjusted under 35 U.S.C. 154(b) by 121 days.

(21) Appl. No.: 15/921,957

(22) Filed: Mar. 15, 2018

(65) Prior Publication Data

US 2019/0048660 A1 Feb. 14, 2019

(30) Foreign Application Priority Data

Aug. 8, 2017 (TW) ..... 106126638 A

(51) Int. Cl.
*E06B 9/78* (2006.01)
*E06B 9/58* (2006.01)
(Continued)

(52) U.S. Cl.
CPC ..... *E06B 9/78* (2013.01); *E06B 9/322* (2013.01); *E06B 9/324* (2013.01); *E06B 9/58* (2013.01);
(Continued)

(58) Field of Classification Search
CPC ... E06B 9/78; E06B 9/58; E06B 9/324; E06B 9/326; E06B 2009/583; E06B 2009/785;
(Continued)

(56) References Cited

U.S. PATENT DOCUMENTS 758,344 A 4/1904 Witte
4,328,605 A * 5/1982 Hutchison ..... F16G 11/101 24/115 G
(Continued)

FOREIGN PATENT DOCUMENTS

CN 205697096 U 11/2016
EP 0302763 A1 * 2/1989 ..... A47H 11/06
(Continued)

OTHER PUBLICATIONS

The Office Action dated Feb. 26, 2018 in corresponding Taiwan Patent Application No. 106126638.

*Primary Examiner* — Johnnie A. Shablack
(74) *Attorney, Agent, or Firm* — Chen Yoshimura LLP

(57) ABSTRACT

A retaining device for an operating member of a window shade includes a casing having an opening, a sliding part having a first and a second inner cavity, and a spring respectively connected with the sliding part and the casing. The sliding part is assembled with the casing, and is movable between a first and a second position, wherein the sliding part in the first position occludes the opening and has the first inner cavity exposed for insertion of an operating member of a window shade, and the sliding part in the second position has the first inner cavity retracted toward an interior of the casing while the second inner cavity overlaps with the opening for facilitating travel of an operating member of a window shade through the opening and the second inner cavity. The spring is operable to urge the sliding part to move toward the first position.

20 Claims, 14 Drawing Sheets

(51) Int. Cl.
*E06B 9/322* (2006.01)
*E06B 9/324* (2006.01)

(52) U.S. Cl.
CPC ... *E06B 2009/583* (2013.01); *E06B 2009/785* (2013.01)

(58) Field of Classification Search
CPC ... A47H 3/00; A47H 3/02; A47H 3/10; A47H 3/12; A47H 3/08; A47H 3/04; A47H 3/06; A47H 5/032; A47H 5/08; Y10T 24/39; Y10T 24/3902; Y10T 24/3969; Y10T 24/3971; Y10T 24/3973
See application file for complete search history.

(56) References Cited

U.S. PATENT DOCUMENTS 4,453,292 A * 6/1984 Bakker ..... F16G 11/101 24/115 G
4,813,469 A * 3/1989 Scott ..... E06B 9/326 160/178.2
4,839,946 A * 6/1989 Murai ..... A45C 13/30 24/115 G
4,846,766 A * 7/1989 Glatzel ..... A47H 11/06 474/138
5,577,543 A * 11/1996 Jelic ..... E06B 9/326 16/442
5,752,558 A * 5/1998 Lin ..... E06B 9/326 16/219
5,845,696 A * 12/1998 Chou ..... E06B 9/36 160/178.1 V
6,792,999 B2 * 9/2004 Cross ..... A47H 3/08 160/321
7,114,544 B2 * 10/2006 Rice ..... E06B 9/322 160/178.1 V
8,539,645 B2 * 9/2013 Marocco ..... A47H 3/08 160/178.1 R
8,650,720 B2 2/2014 Wicker et al.
8,935,832 B2 * 1/2015 Chuang ..... A47H 3/02 160/178.2
9,091,117 B2 * 7/2015 Ng ..... E06B 9/42
9,212,518 B2 * 12/2015 Mann ..... E06B 9/324
9,677,583 B1 6/2017 Wong
10,006,245 B1 * 6/2018 Marocco ..... E06B 9/78
10,111,551 B1 * 10/2018 Wong ..... A47H 3/04
2013/0291341 A1 * 11/2013 Somerfield ..... F16G 11/106 24/136 R
2016/0168907 A1 * 6/2016 Byun ..... E06B 9/326 160/178.2
2017/0145742 A1 * 5/2017 Hendriks ..... E06B 9/326
2017/0260805 A1 * 9/2017 Merker ..... E06B 9/324
2018/0291680 A1 * 10/2018 Marocco ..... E06B 9/326
2018/0320439 A1 * 11/2018 McCreadie ..... E06B 9/324
2019/0040678 A1 * 2/2019 Garcia Garcia ..... E06B 9/326
2019/0195014 A1 * 6/2019 Chua ..... E06B 9/78
2019/0264501 A1 * 8/2019 Marocco ..... E06B 9/324
2019/0264503 A1 * 8/2019 Marocco ..... E06B 9/78

FOREIGN PATENT DOCUMENTS

TW 429763 3/1989
TW M415669 U1 11/2011
TW M527036 U 8/2016
WO WO-2009130519 A1 * 10/2009 ..... E06B 9/78

* cited by examiner

RETAINING DEVICE FOR AN OPERATING MEMBER OF A WINDOW SHADE AND WINDOW SHADE USING THE SAME

CROSS-REFERENCE TO RELATED APPLICATION(S)

This application claims priority to Taiwan Patent Application No. 106126638 filed on Aug. 8, 2017, the disclosure of which is incorporated herein by reference.

BACKGROUND

1. Field of the Invention

The present invention relates to retaining devices and window shades using the same.

2. Description of the Related Art

Window shades are installed in homes to provide shading and privacy or for decorative purposes. Most window shades available on the market usually include operating cords operable to open and close a shade fabric. However, the suspended operating cord may easily swing and inadvertently wrap around the neck of a child, which may cause strangulation accidents.

Therefore, there is a need for a device that can restrict the operating cord of a window shade and address at least the foregoing issues.

SUMMARY

A retaining device for an operating member of a window shade includes a casing having an opening, a sliding part having a first and a second inner cavity, and a spring respectively connected with the sliding part and the casing. The sliding part is slidably assembled with the casing and is movable between a first and a second position, wherein the sliding part in the first position occludes the opening of the casing and has the first inner cavity exposed for insertion of an operating member of a window shade, and the sliding part in the second position has the first inner cavity retracted toward an interior of the casing while the second inner cavity overlaps with the opening of the casing for facilitating travel of an operating member of a window shade through the opening and the second inner cavity. The spring is operable to urge the sliding part to move toward the first position.

Moreover, the present application provides a window shade including the retaining device, an operating member and a shade assembly, the operating member being operable to drive the shade assembly in movement and extending through the retaining device.

DETAILED DESCRIPTION OF THE EMBODIMENTS

Figure 1:
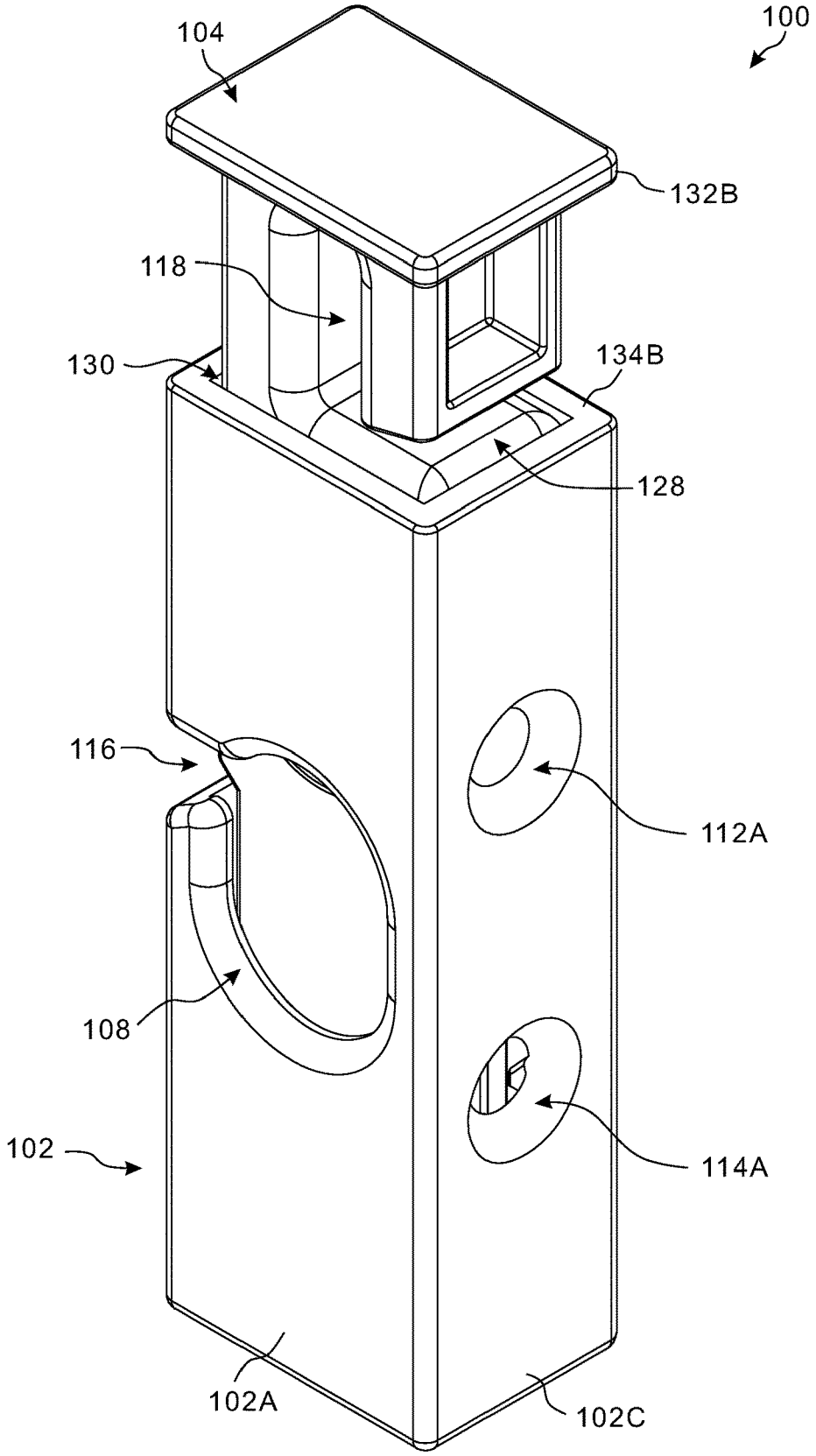
FIG. 1 is a perspective view illustrating an embodiment of a retaining device for an operating member of a window shade.
Figure 2:
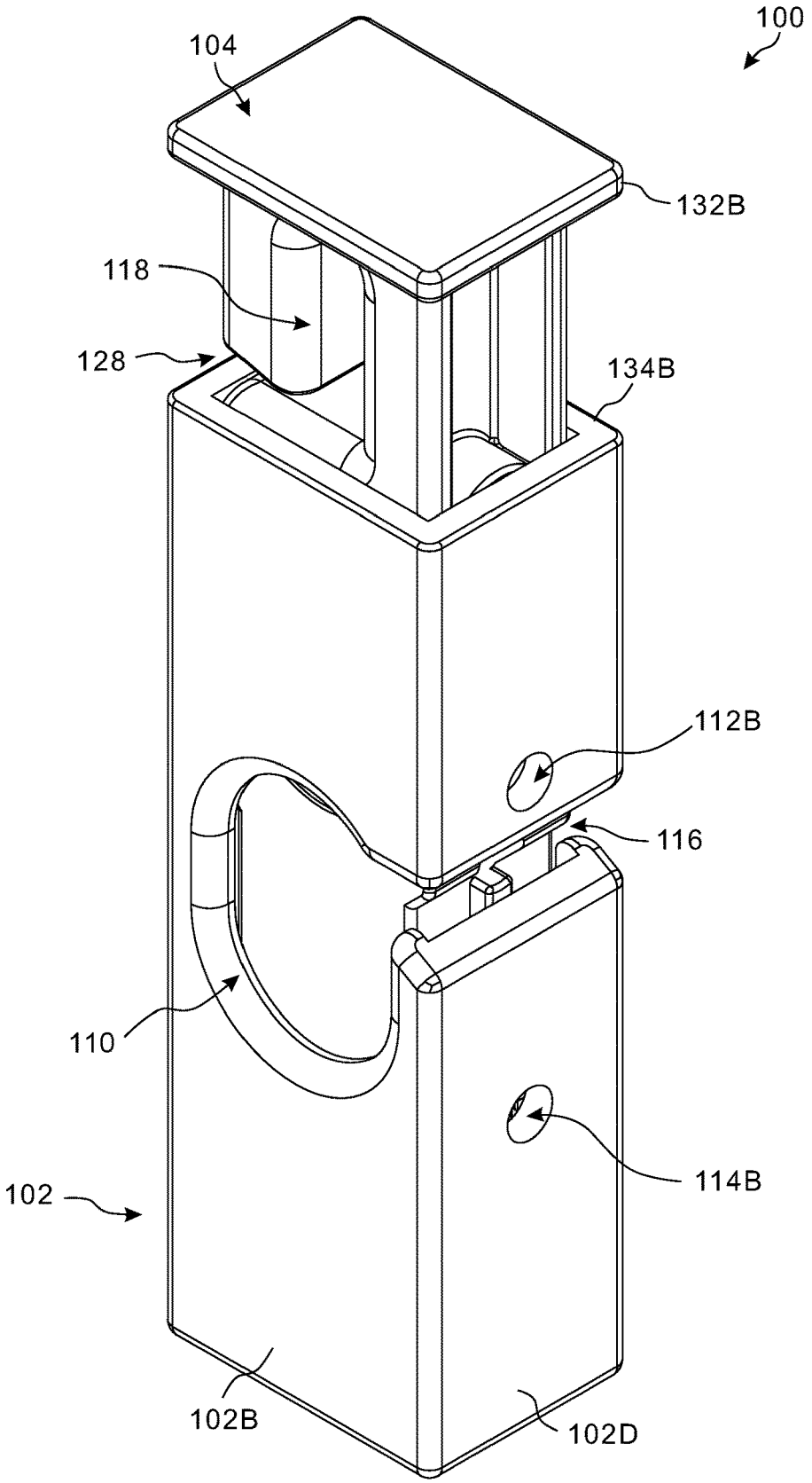
FIG. 2 is a perspective view illustrating the retaining device shown in FIG. 1 under a different viewing angle.
Figure 3:
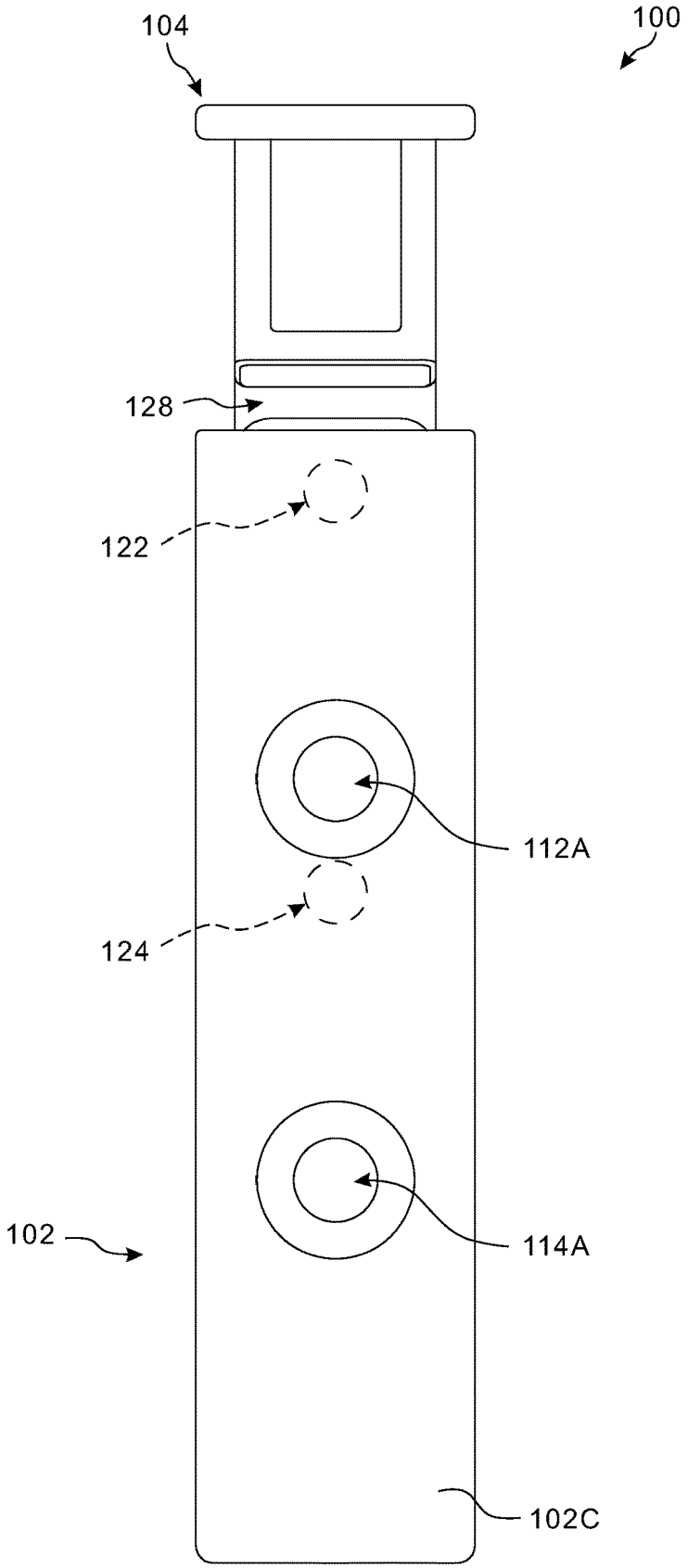
FIG. 3 is a side view of the retaining device.
Figure 4:
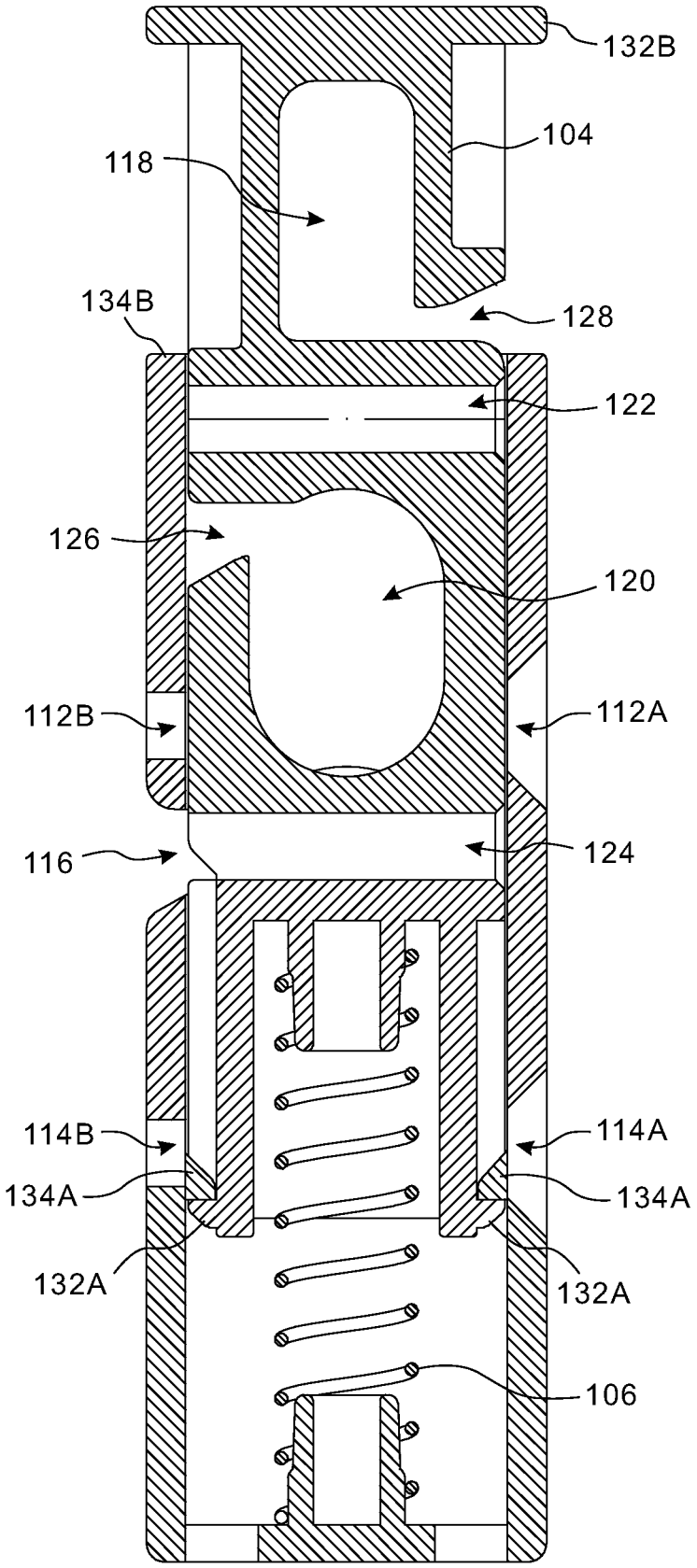
FIG. 4 is a cross-sectional view of the retaining device.
Figure 5:
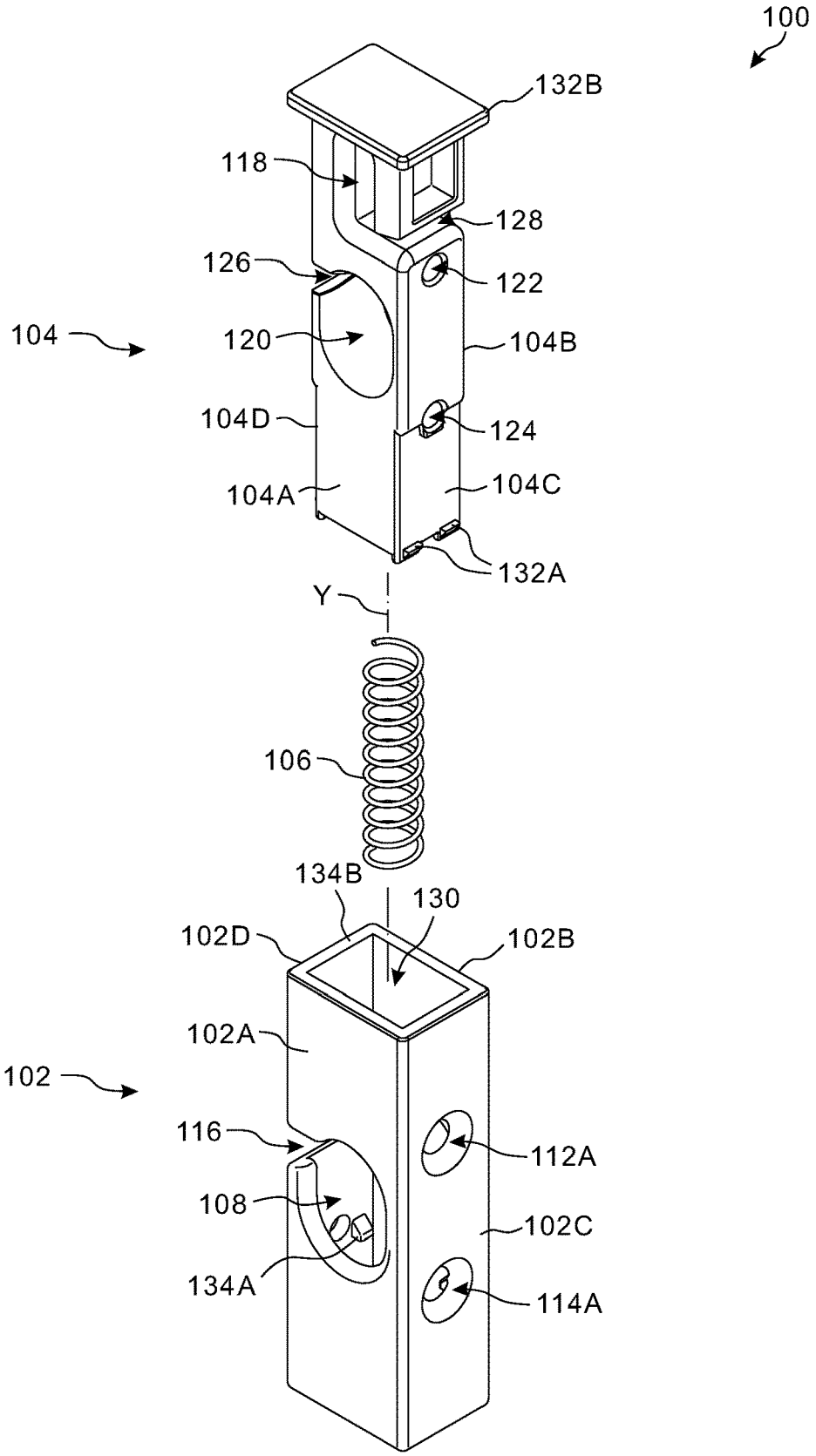
FIG. 5 is an exploded view of the retaining device.
Figure 6:
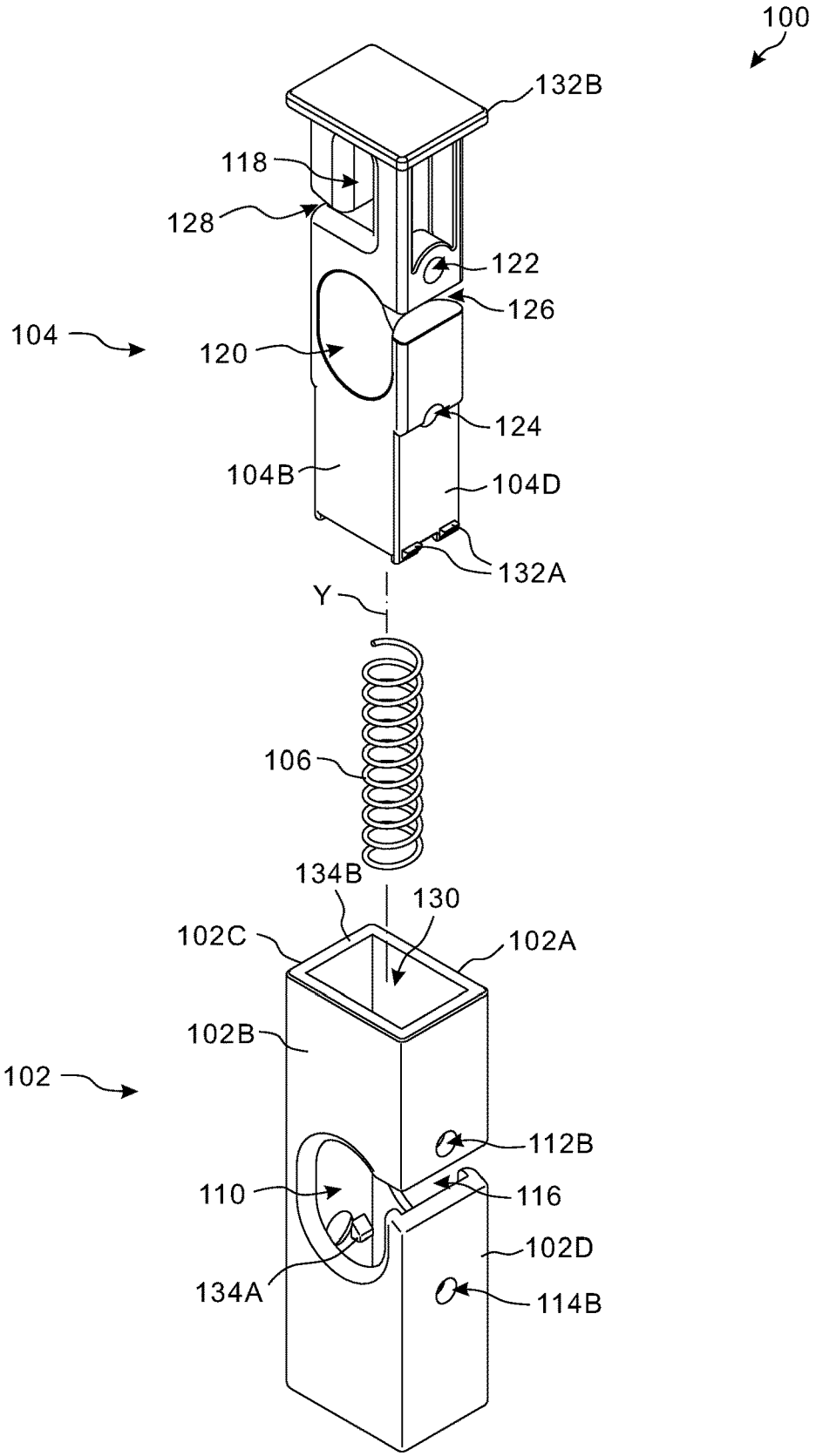
FIG. 6 is an exploded view of the retaining device under a different viewing angle.

FIGS. 1 and 2 are perspective views under different viewing angles illustrating an embodiment of a retaining device 100 for an operating member of a window shade. FIG. 3 is a side view of the retaining device 100. FIG. 4 is a cross-sectional view of the retaining device 100. FIGS. 5 and 6 are exploded views illustrating the retaining device 100 under different viewing angles. The retaining device 100 may be suitable for use with any operating member provided in a window shade, which can include, without limitation, a cord, a string, a ribbon, a bead chain, a strip, a band, and like elongate and flexible operating members. Referring to FIGS. 1-6, the retaining device 100 can include a casing 102, a sliding part 104 and a spring 106. The casing 102 can be made of a rigid material, and can have a hollow interior for assembling the sliding part 104 and the spring 106. The casing 102 can have any suitable shape. According to an embodiment, the casing 102 can exemplary have a rectangular or a square shape. It will be appreciated, however, that other shapes may be suitable.

The hollow interior of the casing 102 can be defined at least partially by a plurality of side surfaces, which can include two opposite side surfaces 102A and 102B and two other opposite side surfaces 102C and 102D. According to an example of construction, the casing 102 can have four sides, the two side surfaces 102A and 102B are parallel to each other and are respectively connected with the two other side surfaces 102C and 102D, the two side surfaces 102C and 102D being parallel to each other. The two side surfaces 102A and 102B can respectively have two openings 108 and 110 that are connected with the hollow interior of the casing 102, so that an operating member of a window shade can travel through the casing 102 via the two openings 108 and 110. For facilitating the passage of the operating member through the casing 102, the side surface 102D can further have a channel 116 that is connected with the two openings 108 and 110 and the hollow interior of the casing 102. Moreover, the side surface 102C can have two holes 112A and 114A, and the side surface 102D can have two other holes 112B and 114B that are respectively aligned with the two holes 112A and 114A. An end of the casing 102 can further include an opening 130 connected with the hollow interior of the casing 102.

Referring to FIGS. 1-6, the sliding part 104 is slidably connected with the casing 102 through the opening 130, and can slide relative to the casing 102 along a lengthwise axis Y. The sliding part 104 can be made of a rigid material, and can have any suitable shape. According to an example of construction, the sliding part 104 can have square or rectangular shape. It will be appreciated, however, that the sliding part 104 may have other shapes. The sliding part 104 can have a plurality of side surfaces, including two opposite side surfaces 104A and 104B, and two other opposite side surfaces 104C and 104D. According to an example of construction, the sliding part 104 can have four sides, the two side surfaces 104A and 104B are parallel to each other and respectively connected with the two other side surfaces 104C and 104D, and the two side surfaces 104C and 104D being also parallel to each other. The sliding part 104 can have two inner cavities 118 and 120 that are disposed along the lengthwise axis Y spaced apart from each other. The inner cavity 118 can be respectively opened on the two side surfaces 104A and 104B, and the inner cavity 120 can also be respectively opened on the two side surfaces 104A and 104B. An operating member of a window shade can be disposed through the sliding part 104 by passing through the inner cavity 118 and/or 120. For facilitating the placement of an operating member through the sliding part 104, the side surface 104D can have a channel 126 connected with the inner cavity 120, and the side surface 104C can have a channel 128 connected with the inner cavity 118. Moreover, the sliding part 104 can further include two holes 122 and 124 each of which respectively extending through the side surfaces 104C and 104D. When the sliding part 104 is assembled with the casing 102, the side surfaces 104A and 104B of the sliding part 104 can respectively correspond to the side surfaces 102A and 102B of the casing 102, the side surfaces 104C and 104D can respectively correspond to the side surfaces 102C and 102D of the casing 102, and the inner cavities 118 and 120 and the openings 108 and 110 can be disposed along the lengthwise axis Y.

For limiting a travel range of the sliding part 104 relative to the casing 102, an interior of the casing 102 can include two spaced-apart stop portions 134A and 134B. The stop portion 134A can be exemplary a protrusion provided in the casing 102, and the stop portion 134B can be exemplary an edge of the opening 130. A contact between the sliding part 104 and the stop portion 134A can stop the sliding part 104 and prevent its sliding displacement in a first direction, which corresponds to a first end of the travel range of the sliding part 104. A contact between the sliding part 104 and the stop portion 134B can stop the sliding part 104 and prevent its sliding displacement in an opposite second direction, which corresponds to a second end of the travel range of the sliding part 104. According to an example of construction, the sliding part 104 can have two spaced-apart flanges 132A and 132B, a contact between the flange 132A and the stop portion 134A can stop the sliding part 104 at the first end of its travel range, and a contact between the flange 132B and the stop portion 134B can stop the sliding part 104 at the second end of its travel range.

The spring 106 can be disposed inside the casing 102, and can be respectively connected with the sliding part 104 and the casing 102. The spring 106 can bias the sliding part 104 to slide along the lengthwise axis Y relative to the casing 102 for protruding outward through the opening 130 of the casing 102.

The sliding part 104 can slide through an interior space of the casing 102 delimited at least partially between the side surfaces 102A, 102B, 102C and 102D thereof. In particular, the sliding part 104 can slide relative to the casing 102 between a first position illustrated in FIGS. 1-4 and a second position illustrated in FIGS. 7 and 8.

When the sliding part 104 is in the first position shown in FIGS. 1-4, the hole 122 in the sliding part 104 is misaligned and does not overlap with the holes 112A and 112B of the casing 102, the hole 124 in the sliding part 104 is misaligned and does not overlap with the holes 114A and 114B of the casing 102, and the sliding part 104 can occlude the holes 112A, 112B, 114A and 114B of the casing 102. Moreover, the channel 126 of the sliding part 104 is misaligned and does not overlap with the channel 116 of the casing 102, the sliding part 104 can substantially occlude the openings 108 and 110, and an end portion of the sliding part 104 can extend outward through the opening 130 of the casing 102 so that the inner cavity 118 and the channel 128 of the sliding part 104 are exposed outside the casing 102. While the sliding part 104 is in the first position, an operating member of a window shade can be inserted through the channel 128 into the inner cavity 118. Since the sliding part 104 can substantially occlude the openings 108 and 110 and the channel 116 of the casing 102 in the first position, insertion of an operating member of a window shade through the channels 116 and 126 into the openings 108 and 110 of the casing 102 and the inner cavity 120 of the sliding part 104 can be prevented. The biasing action applied by the spring 106 can urge the sliding part 104 to slide toward the first position. According to an example of construction, the flange 132A of the sliding part 104 can contact against the stop portion 134A of the casing 102 to stop the sliding part 104 in the first position.

Figure 7:
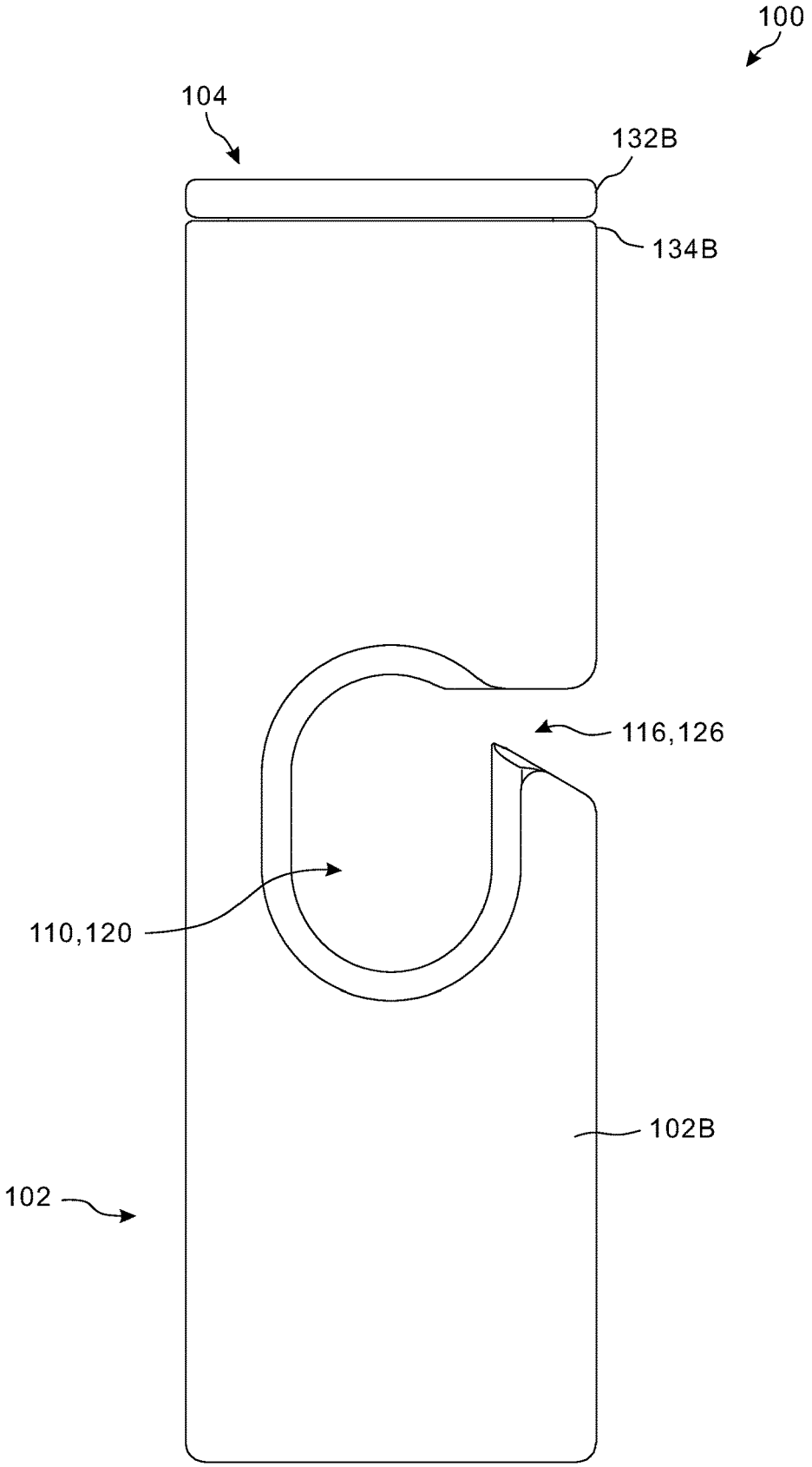
FIGS. 7 and 8 are different side views illustrating the retaining device with the sliding part thereof in a second position.
Figure 8:
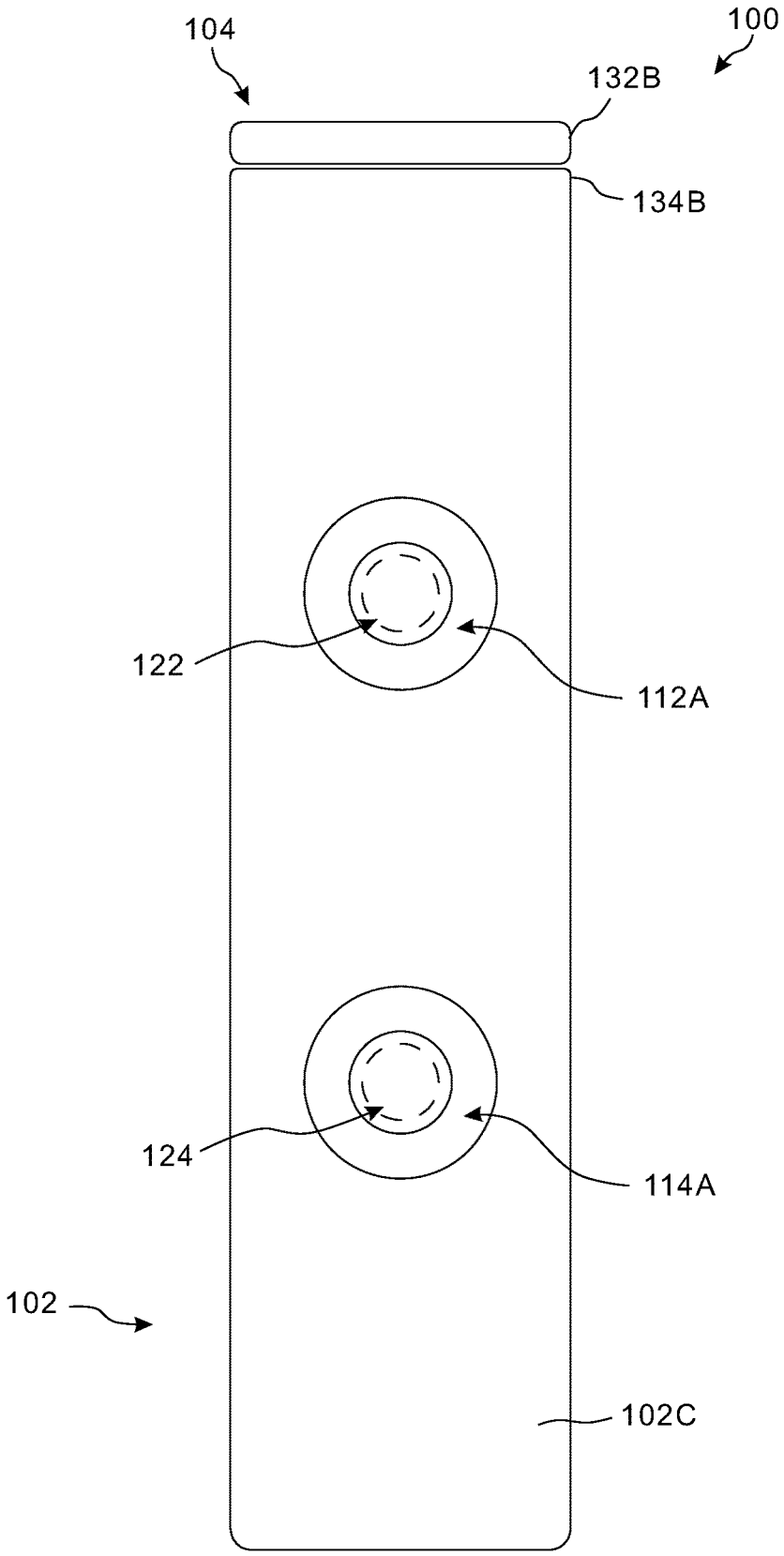
Figure 9:
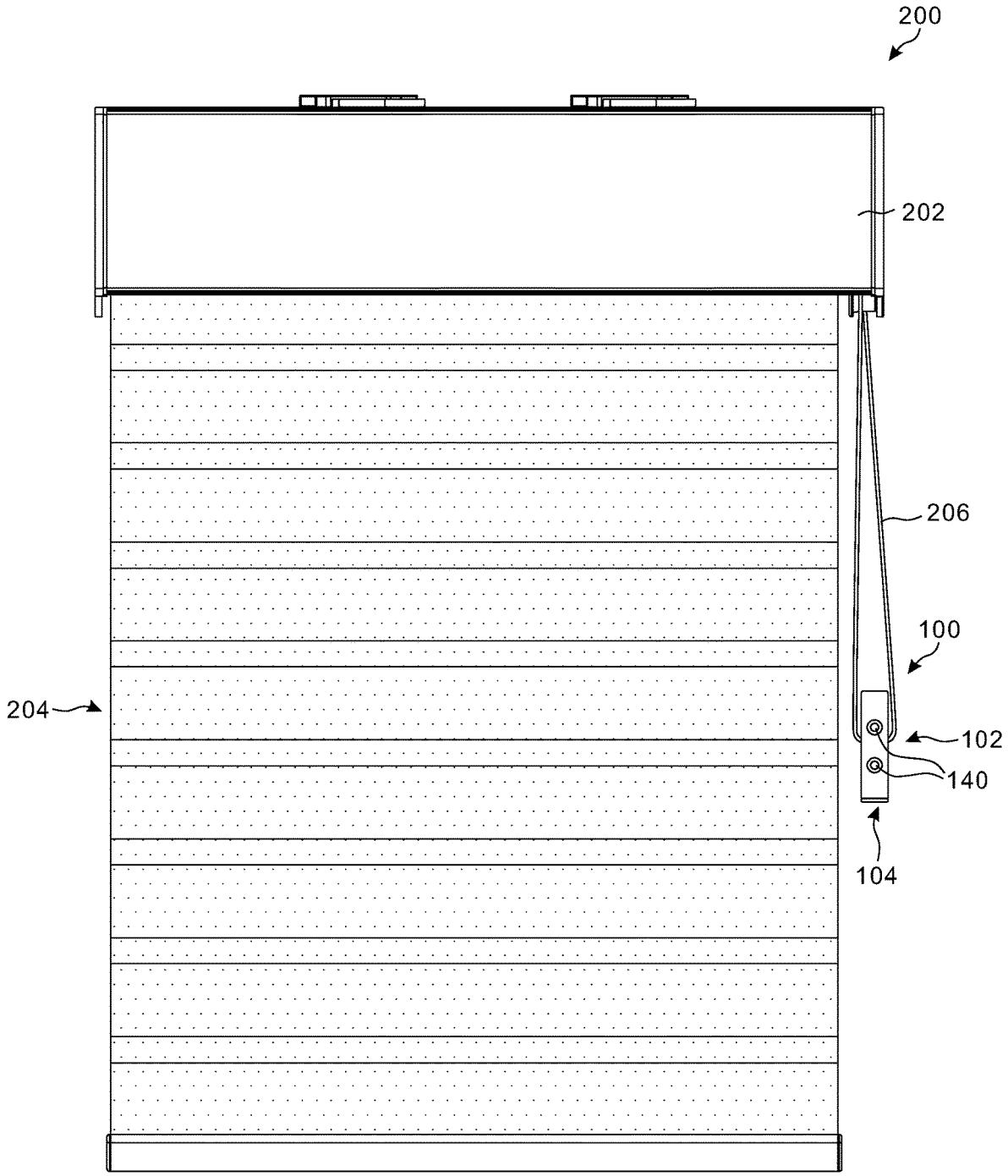
FIG. 9 is a schematic view illustrating a configuration of use of the retaining device with a window shade.
Figure 10:
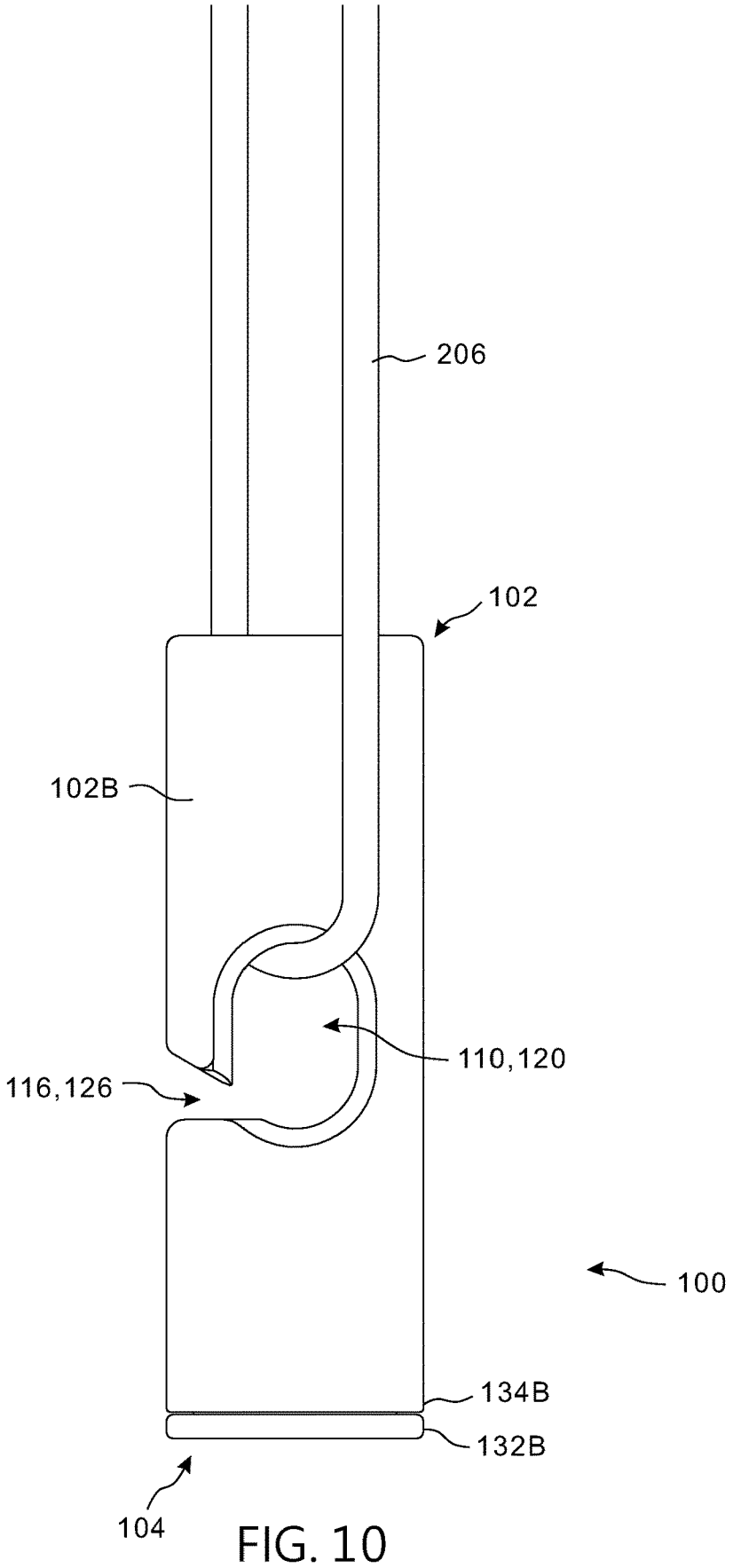
FIG. 10 is an enlarged view illustrating an operating member of the window shade shown in FIG. 9 positioned through the retaining device.
Figure 11:
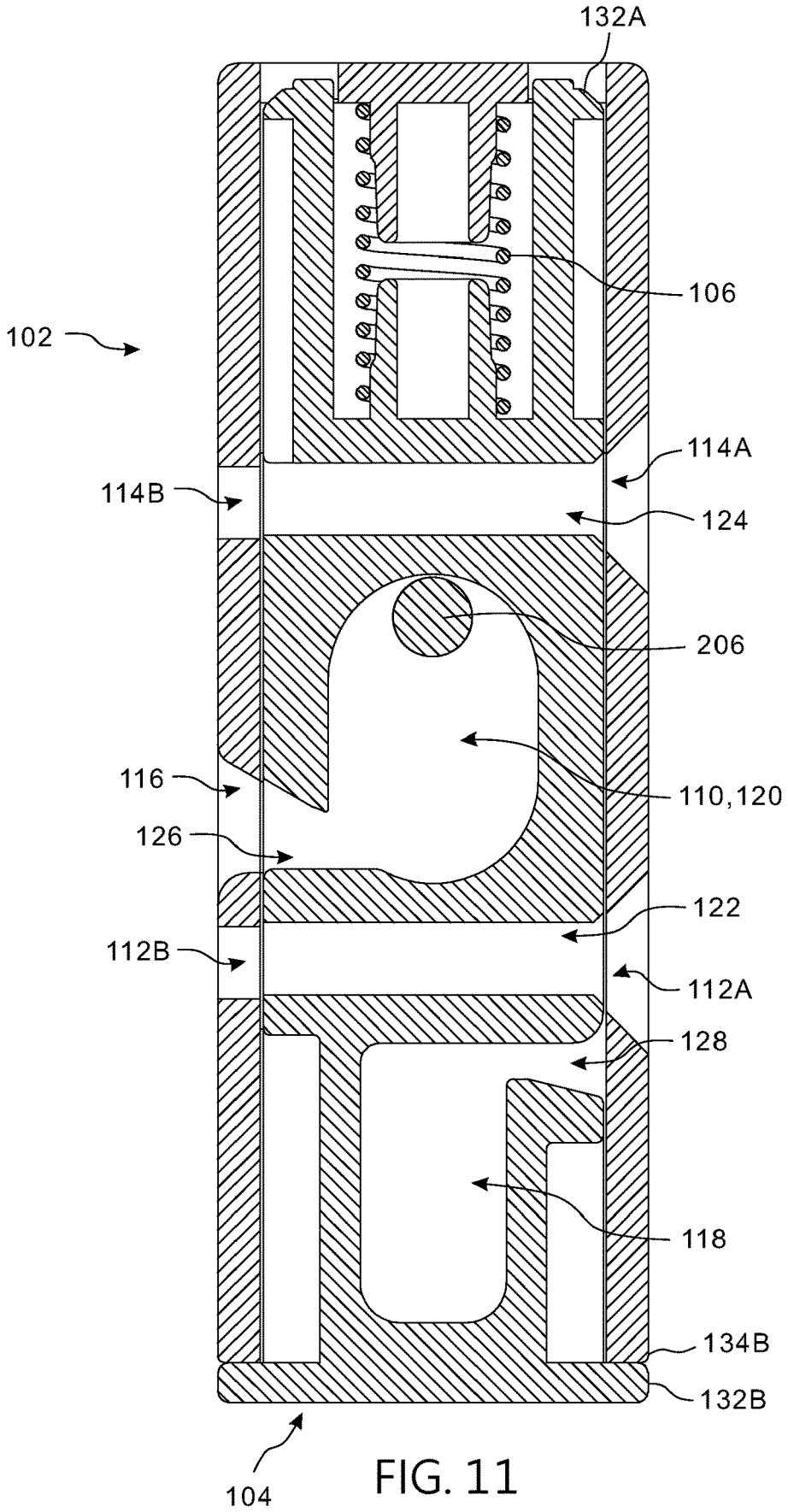
FIG. 11 is a cross-sectional view illustrating the retaining device installed with the operating member of the window shade shown in FIG. 9.
Figure 12:
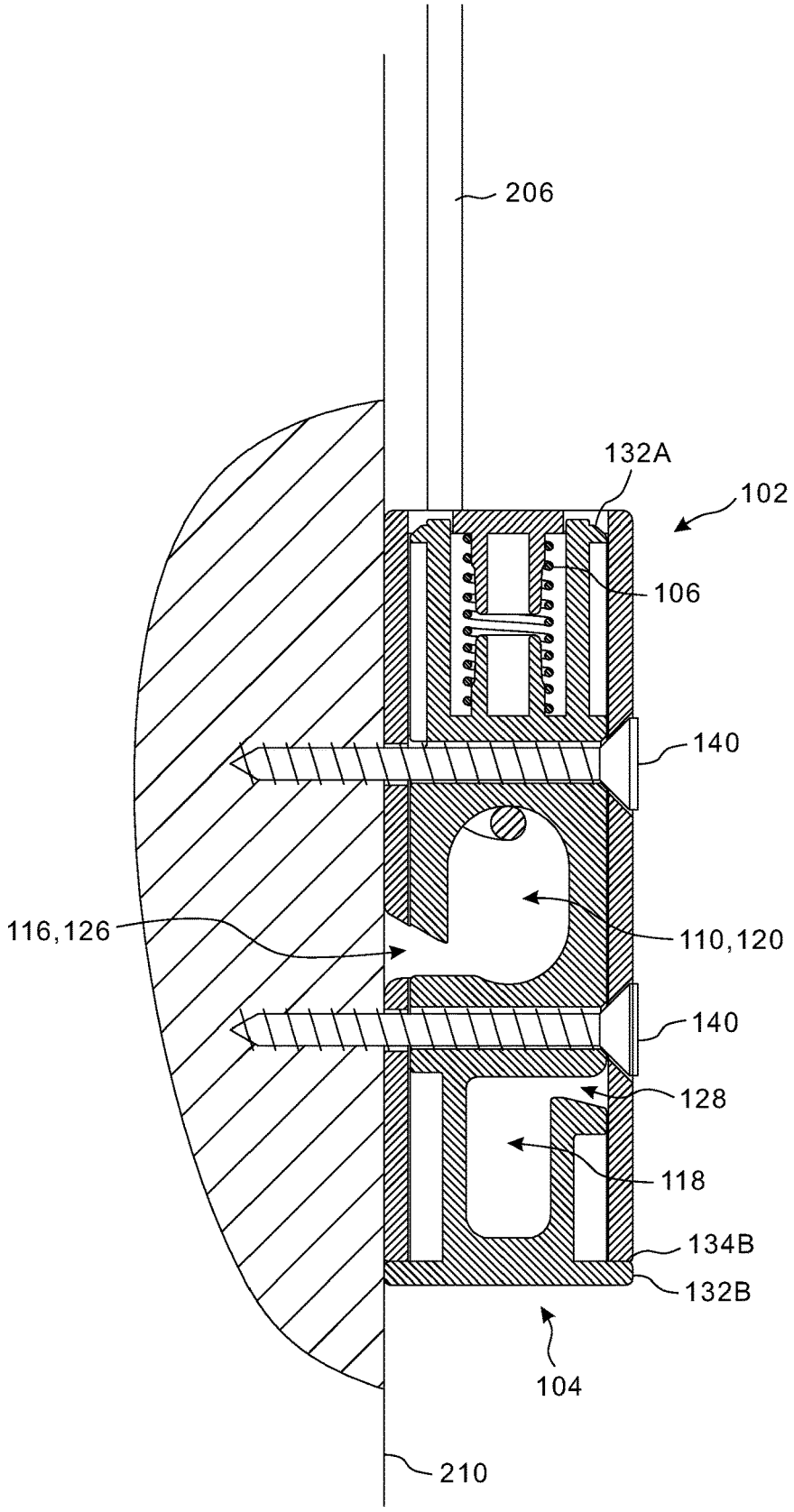
FIG. 12 is a cross-sectional view illustrating a configuration of use in which the operating member of the window shade shown in FIG. 9 is restrictedly positioned through the retaining device and the retaining device is attached to a fixed surface.

When the sliding part 104 is in the second position shown in FIGS. 7 and 8, the hole 122 of the sliding part 104 can respectively overlap with the holes 112A and 112B of the casing 102, and the hole 124 of the sliding part 104 can respectively overlap with the holes 114A and 114B of the casing 102. Moreover, the inner cavity 120 of the sliding part 104 can substantially overlap with the openings 108 and 110 of the casing 102, the channel 126 of the sliding part 104 can overlap with the channel 116 of the casing 102, and the inner cavity 118 and channel 128 of the sliding part 104 can be retracted toward the interior of the casing 102. While the sliding part 104 is in the second position, an operating member of a window shade can be inserted through the channels 116 and 126 into the openings 108 and 110 of the casing 102 and the inner cavity 120 of the sliding part 104. The operating member of the window shade thereby installed can freely slide through the retaining device 100, in particular through the openings 108 and 110 of the casing 102 and the inner cavity 120 of the sliding part 104.

The retaining device 100 can be used in association with a window shade, and can have different configurations of use for restrictedly positioning an operating member of the window shade. FIGS. 9-12 illustrate an exemplary configuration of use of the retaining device 100 with a window shade 200. Referring to FIGS. 9-12, the window shade 200 can exemplary include a head rail 202, a shade assembly 204 and an operating member 206 extending vertically. The operating member 206 is exposed outward, and is operable to drive the shade assembly 204 in movement relative to the head rail 202. For example, a user can pull the operating member 206 to cause the shade assembly 204 to move upward and downward. The operating member 206 can be exemplary a cord, a strip or a bead chain. According to an embodiment, the operating member 206 may have a closed-loop form.

In the configuration of use shown in FIGS. 9-12, the retaining device 100 can further include one or a plurality of fasteners 140, which may exemplary include screws. For setting the configuration of use shown in FIGS. 9-12, the sliding part 104 can be pushed to slide against the biasing force of the spring 106 to the second position. According to an embodiment, the flange 132B of the sliding part 104 can contact with the stop portion 134B of the casing 102 to stop the sliding part 104 in the second position. While the sliding part 104 remains in the second position, the operating member 206 can be inserted through the channels 116 and 126 into the openings 108 and 110 of the casing 102 and the inner cavity 120 of the sliding part 104, and the retaining device 100 then can be attached to a fixed surface 210 via the fasteners 140. The fixed surface 210 may be a sidewall surface or other fixed surfaces in a building. For attaching the retaining device 100 to the fixed surface 210 with the sliding part 104 locked in the second position, one fastener 140 can pass through the hole 122 of the sliding part 104 and the holes 112A and 112B of the casing 102 and engage and lock with the fixed surface 210, and another fastener 140 can pass through the hole 124 of the sliding part 104 and the holes 114A and 114B of the casing 102 and engage and lock with the fixed surface 210. The retaining device 100 can be thereby set in the configuration of use shown in FIGS. 9-12. In this configuration, the operating member 206 can extend through the inner cavity 120 of the sliding part 104 and the openings 108 and 110 of the casing 102, but does not pass through the inner cavity 118 of the sliding part 104. The retaining device 100 can thereby restrictedly position the operating member 206 adjacent to the fixed surface 210 and prevent accidental wrapping of the operating member 206 around the neck of a child. In the meantime, the retaining device 100 allows the operating member 206 to move upward and downward through the retaining device 100, and does not impede regular operation of the operating member 206.

According to an embodiment, the retaining device 100 can be attached to the fixed surface 210 with the side surface 102D positioned adjacent to the fixed surface 210 so that the fixed surface 210 can occlude the channel 116 of the casing 102 and the channel 126 of the sliding part 104 for preventing the operating member 206 from separating from the retaining device 100.

Figure 13:
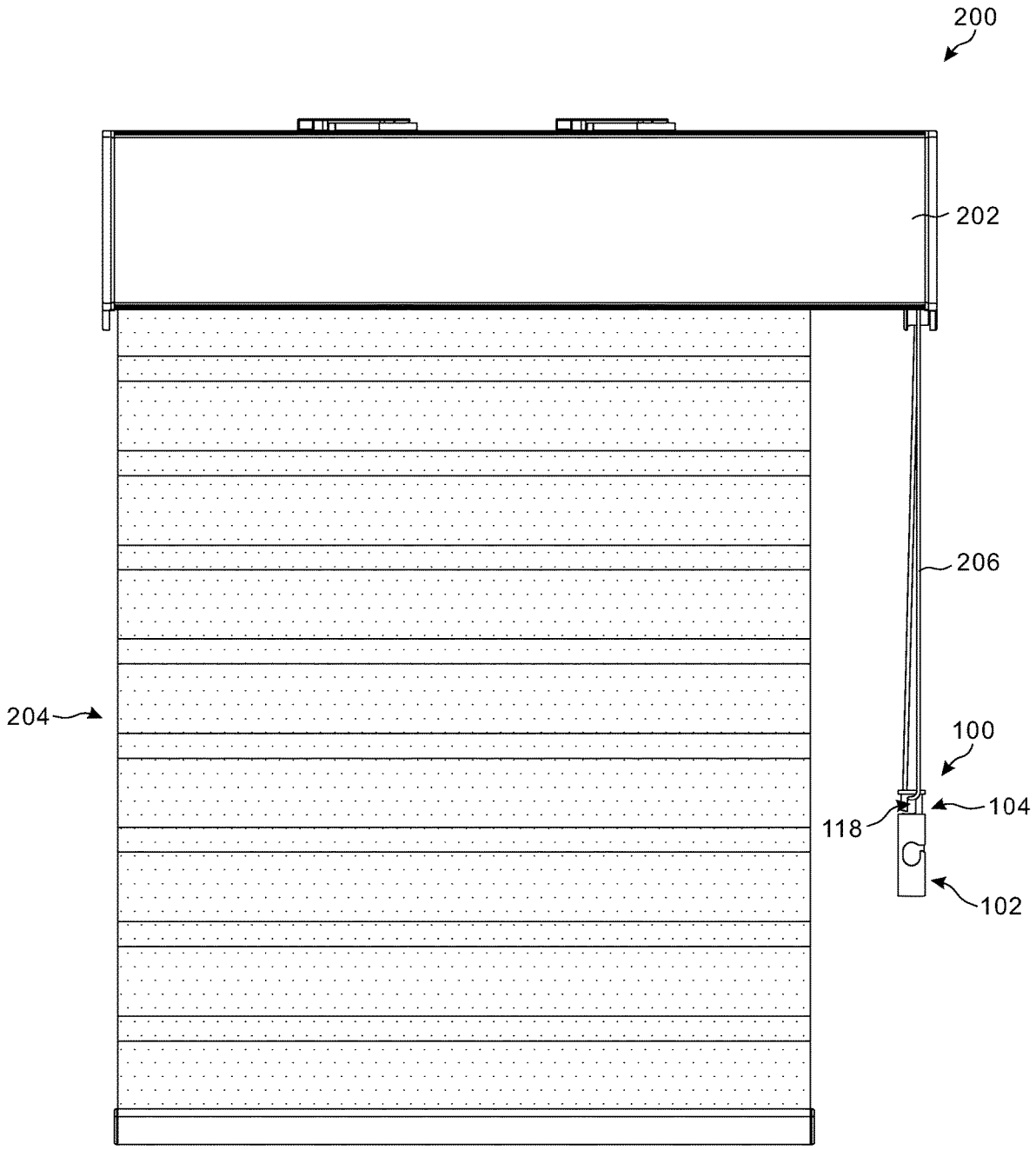
FIGS. 13 and 14 are schematic views illustrating another configuration of use of the retaining device with a window shade.
Figure 14:
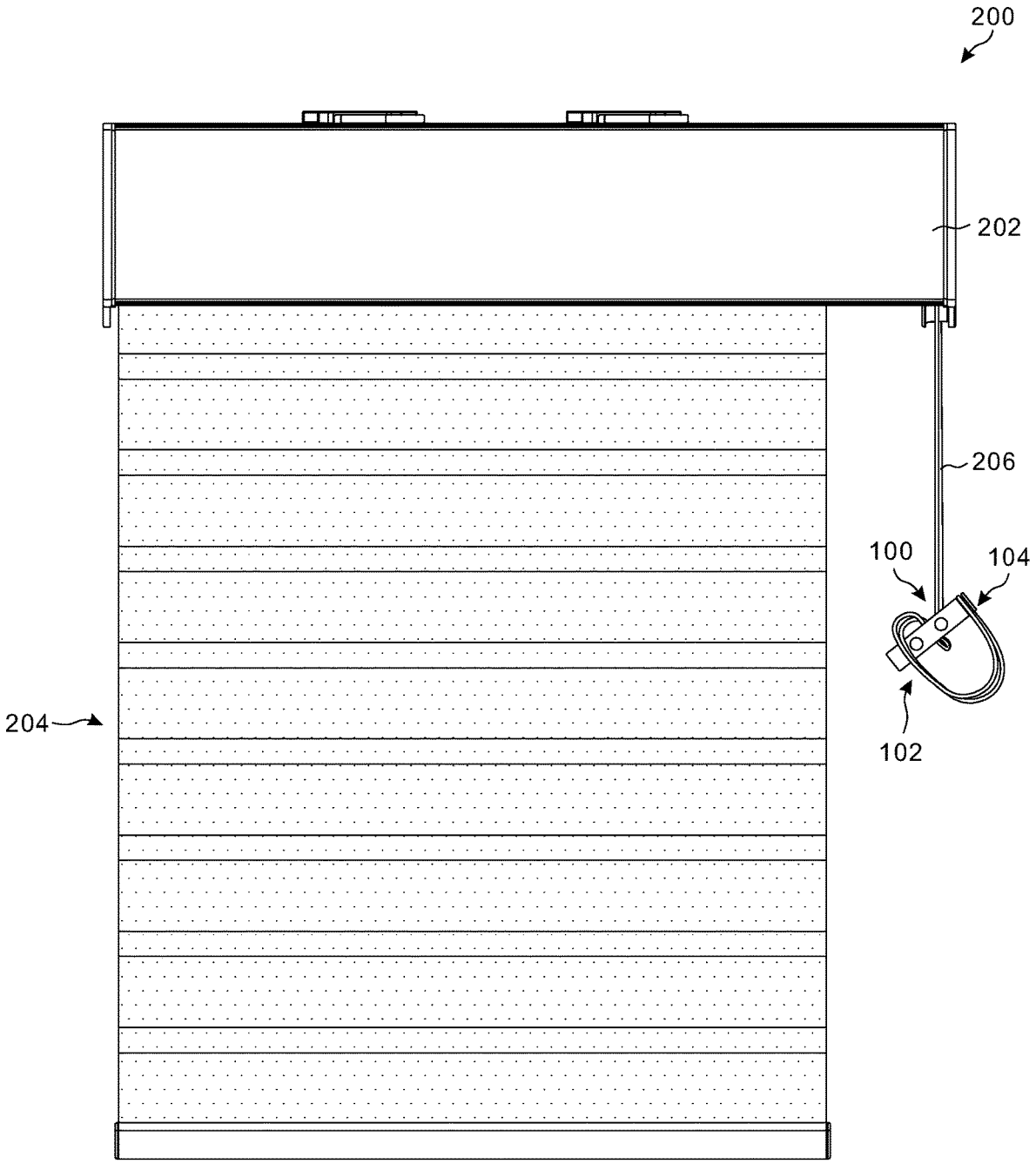

FIGS. 13 and 14 illustrate another configuration of use of the retaining device 100 with the window shade 200. For setting the configuration of use shown in FIGS. 13 and 14, the sliding part 104 is allowed to move to the first position protruding outside the opening 130 of the casing 102 via the biasing force of the spring 106 (shown in FIGS. 5 and 6), thereby the inner cavity 118 and the channel 128 of the sliding part 104 can be exposed outside the casing 102. While the sliding part 104 remains in the first position, the operating member 206 can be inserted through the channel 128 into the inner cavity 118 of the sliding part 104. The operating member 206 can thereby extend through inner cavity 118 of the sliding part 104, and the retaining device 100 can hang from the operating member 206. Then the sliding part 104 can be pushed to slide to a third position between the aforementioned first and second positions so that the inner cavity 118 of the sliding part 104 is partially exposed outward and the inner cavity 120 of the sliding part 104 partially overlaps with the openings 108 and 110 of the casing 102. While the sliding part 104 remains in the third position, a portion of the operating member 206 between the head rail 202 and the retaining device 100 can be folded and inserted into the inner cavities 118 and 120 and the openings 108 and 110. Then the spring 106 of the retaining device 100 (shown in FIGS. 5 and 6) can urge the sliding part 104 to move toward the first position, which thereby clamps the operating member 206 between the casing 102 and the sliding part 104 as shown in FIG. 14. In the configuration shown in FIG. 14, the retaining device 100 can receive the operating member 206 through the inner cavities 118 and 120 and the openings 108 and 110, the operating member 206 being folded to have multiple portions clamped between the casing 102 and the sliding part 104 with a part of the operating member 206 between the inner cavity 118 and the openings 108 and 110 forming a closed loop. In this configuration, the retaining device 100 can hang from the operating member 206, and can reduce a length of the operating member 206 between the head rail 202 and the retaining device 100. Accordingly, a vertical length of the operating member 206 hanging from the head rail 202 can be reduced and the operating member 206 can be positioned at a greater height more difficult to reach for a child, which can prevent accidental wrapping of the operating member 206 around the neck of a child. A user can conveniently adjust the vertical length of the operating member 206 hanging from the head rail 202 by changing the folded length of the operating member 206.

The retaining device described herein is simple in construction, and can have multiple configurations of use for preventing accidental wrapping of an operating member of a window shade around the neck of a child.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A retaining device for an operating member of a window shade, comprising:

a casing having an opening;

a sliding part having a first and a second inner cavity, the sliding part being slidably assembled with the casing and movable between a first and a second position, wherein the sliding part in the first position occludes the opening of the casing and has the first inner cavity exposed for insertion of an operating member of a window shade, and the sliding part in the second position has the first inner cavity retracted toward an interior of the casing while the second inner cavity overlaps with the opening of the casing for facilitating travel of an operating member of a window shade through the opening and the second inner cavity; and a spring respectively connected with the sliding part and the casing, the spring being operable to urge the sliding part to move toward the first position;

wherein the casing has a side surface provided with a first channel connected with the opening, and the sliding part has a side surface provided with a second channel connected with the second inner cavity, the first and second channels being nonoverlapping and the sliding part substantially occluding the first channel in the first position so that insertion of an operating member of a window shade through the first channel into the opening is prevented, and the first and second channels overlapping each other in the second position for insertion of an operating member of a window shade through the first and second channels into the second inner cavity and the opening.

2. The retaining device according to claim 1, wherein the first inner cavity is partially exposed outside the casing and the second inner cavity partially overlaps with the opening when the sliding part is in a third position between the first and second positions, thereby allowing an operating member of a window shade to be respectively received through the first and second inner cavities and the opening.

3. The retaining device according to claim 1, wherein the sliding part has a side surface provided with a third channel connected with the first inner cavity, the third channel being exposed outside the casing when the sliding part is in the first position for insertion of an operating member of a window shade through the third channel into the first inner cavity.

4. The retaining device according to claim 1, wherein the sliding part is slidable along a lengthwise axis relative to the casing, and the first and second inner cavities and the opening are disposed along the lengthwise axis.

5. The retaining device according to claim 1, wherein the casing includes a first hole, the sliding part includes a second hole, and the retaining device further includes a fastener, the fastener being positionable through the first and second holes to lock the sliding part in the second position.

6. The retaining device according to claim 5, wherein the first and second holes are nonoverlapping when the sliding part is in the first position.

7. The retaining device according to claim 5, wherein the fastener is a screw.

8. A window shade comprising:

an operating member and a shade assembly, the operating member being operable to drive the shade assembly in movement; and the retaining device according to claim 1, wherein the operating member is positionable to extend through the retaining device.

9. The window shade according to claim 8, wherein the operating member is positionable to respectively extend through the first and second inner cavities and the opening and be clamped between the casing and the sliding part, the operating member thereby forming a closed loop between the first inner cavity and the opening.

10. The window shade according to claim 9, wherein the operating member is foldable to have multiple portions clamped between the casing and the sliding part.

11. The window shade according to claim 8, wherein the operating member is positionable to extend through the second inner cavity of the sliding part and the opening of the casing without passing through the first inner cavity of the sliding part.

12. The window shade according to claim 11, wherein the sliding part is locked in the second position.

13. The window shade according to claim 8, wherein the operating member is an elongate and flexible operating member, including a cord, a string, a ribbon, a bead chain, a strip or a band.

14. A retaining device for an operating member of a window shade, comprising:

a casing having an opening;

a sliding part having a first and a second inner cavity and a side surface provided with a channel connected with the first inner cavity, the sliding part being slidably assembled with the casing and movable between a first and a second position, wherein the sliding part in the first position occludes the opening of the casing and has the first inner cavity and the channel exposed outside the casing for insertion of an operating member of a window shade through the channel into the first inner cavity, and the sliding part in the second position has the first inner cavity retracted toward an interior of the casing while the second inner cavity overlaps with the opening of the casing for facilitating travel of an operating member of a window shade through the opening and the second inner cavity; and a spring respectively connected with the sliding part and the casing, the spring being operable to urge the sliding part to move toward the first position.

15. The retaining device according to claim 14, wherein the sliding part blocks passage of an operating member of a window shade through the opening in the first position.

16. The retaining device according to claim 14, wherein the first inner cavity is partially exposed outside the casing and the second inner cavity partially overlaps with the opening when the sliding part is in a third position between the first and second positions, thereby allowing an operating member of a window shade to be respectively received through the first and second inner cavities and the opening.

17. A window shade comprising:

an operating member and a shade assembly, the operating member being operable to drive the shade assembly in movement; and the retaining device according to claim 14, wherein the operating member is positionable to extend through the retaining device.

18. A retaining device for an operating member of a window shade, comprising:

a casing having an opening and a first hole;

a sliding part having a first and a second inner cavity and a second hole, the sliding part being slidably assembled with the casing and movable between a first and a second position, wherein the sliding part in the first position occludes the opening of the casing and has the first inner cavity exposed for insertion of an operating member of a window shade, and the sliding part in the second position has the first inner cavity retracted toward an interior of the casing while the second inner cavity overlaps with the opening of the casing for facilitating travel of an operating member of a window shade through the opening and the second inner cavity;

a spring respectively connected with the sliding part and the casing, the spring being operable to urge the sliding part to move toward the first position; and a fastener positionable through the first and second holes to lock the sliding part in the second position, the first and second holes being nonoverlapping when the sliding part is in the first position.

19. The retaining device according to claim 18, wherein the fastener is a screw.

20. A window shade comprising:

an operating member and a shade assembly, the operating member being operable to drive the shade assembly in movement; and the retaining device according to claim 18, wherein the operating member is positionable to extend through the retaining device.

* * * * *